US010026582B2

(12) United States Patent
Sasai et al.

(10) Patent No.: US 10,026,582 B2
(45) Date of Patent: Jul. 17, 2018

(54) THERMIONIC EMISSION FILAMENT, QUADRUPOLE MASS SPECTROMETER AND RESIDUAL GAS ANALYZING METHOD

(71) Applicant: HORIBA STEC, CO., LTD., Kyoto (JP)

(72) Inventors: Kohei Sasai, Kyoto (JP); Toshihiro Ikeyama, Kyoto (JP); Toshiaki Sakai, Kyoto (JP)

(73) Assignee: HORIBA STEC, CO., LTD., Kyoto (JP)

( * ) Notice: Subject to any disclaimer, the term of this patent is extended or adjusted under 35 U.S.C. 154(b) by 0 days.

(21) Appl. No.: 15/371,511

(22) Filed: Dec. 7, 2016

(65) Prior Publication Data

US 2017/0169981 A1 Jun. 15, 2017

(30) Foreign Application Priority Data

Dec. 11, 2015 (JP) ..... 2015-242477

(51) Int. Cl.

| | |
|---|---|
| ***H01J 9/04*** | (2006.01) |
| ***H01J 1/14*** | (2006.01) |
| ***H01J 1/146*** | (2006.01) |
| ***H01J 49/42*** | (2006.01) |

(52) U.S. Cl.

CPC ..... *H01J 1/146* (2013.01); *H01J 9/042* (2013.01); *H01J 49/4215* (2013.01)

(58) Field of Classification Search

CPC ..... H01J 9/04; H01J 9/08; H01J 1/14; H01J 1/15; H01J 1/22; H01J 1/26; H01J 1/148; H01J 1/146; H01J 1/144; H01J 37/32477; H01J 37/3178; H01J 35/06; H01J 29/04; H01J 49/08; H01J 61/0735

USPC ..... 313/346 R, 345, 311, 340, 310, 633, 636

See application file for complete search history.

(56) References Cited

U.S. PATENT DOCUMENTS

| | | | | |
|---|---|---|---|---|
| 3,372,297 A | | 3/1968 | Pearsall et al. | |
| 4,250,429 A | * | 2/1981 | Lersmacher | H01J 1/26 252/511 |
| 4,533,852 A | | 8/1985 | Frank et al. | |

(Continued)

FOREIGN PATENT DOCUMENTS

| | | |
|---|---|---|
| JP | 2012-3976 | 1/2012 |

OTHER PUBLICATIONS

Naoki Takahashi, "The Quadrupole Mass Spectrometer as a Residual Gas Analyzer", J. Vac. Soc. Jpn., vol. 48 , 2005, pp. 611-618 (per M.P.E.P. § 609.04(a)(III), please see the Specification at, e.g., pp. 1 and 2, of the present appliation for a concise explanation of relevance of this Japanese-language material).

(Continued)

*Primary Examiner* — David A Vanore

(74) *Attorney, Agent, or Firm* — Greenblum & Bernstein, P.L.C.

(57) ABSTRACT

In order to provide a thermionic emission filament capable of ensuring a long life and improving an analysis accuracy of a mass spectrometer using the thermionic emission filament, in the thermionic emission filament including a core member through which electric current flows and an electron emitting layer which is formed so as to cover a surface of the core member, the electron emitting layer is configured to have denseness for substantial gas-tight integrity.

6 Claims, 3 Drawing Sheets

(56) References Cited

U.S. PATENT DOCUMENTS

| | | | | |
|---|---|---|---|---|
| 4,904,897 | A * | 2/1990 | Van Esdonk | H01J 1/26 313/346 R |
| 5,314,570 | A * | 5/1994 | Ikegaya | C23C 16/27 117/103 |
| 2001/0028209 | A1* | 10/2001 | Uemura | B82Y 10/00 313/311 |
| 2004/0021408 | A1* | 2/2004 | Wort | H01J 1/24 313/346 R |
| 2005/0062392 | A1* | 3/2005 | Sakai | H01J 1/15 313/311 |
| 2007/0215283 | A1 | 9/2007 | Kobayashi | |
| 2009/0153013 | A1* | 6/2009 | Nishimura | H01J 1/30 313/311 |
| 2010/0213363 | A1* | 8/2010 | Nakajima | G01N 27/62 250/281 |

OTHER PUBLICATIONS

Extended European Search Report issued in EP Appl. No. 16 00 2630.8 dated May 2, 2017.

John J. Manura, "Note 92: Yttria Coated Mass Spectrometer Filaments", Jan. 1, 2005, URL:http://www.sisweb.com/reference/applnote/app-92.htm.

* cited by examiner

THERMIONIC EMISSION FILAMENT, QUADRUPOLE MASS SPECTROMETER AND RESIDUAL GAS ANALYZING METHOD

TECHNICAL FIELD

The present invention relates to a thermionic emission filament used in, for example, a mass spectrometer.

BACKGROUND ART

Conventionally, as a thermionic emission filament of this type, there has been known that an electron emitting layer is formed by coating a surface of a core member made of iridium with an electron emitting substance made of yttrium oxide. As disclosed in Patent Literature 1 and Non-Patent Literature 1, the electron emitting layer is conventionally coated on the surface of the core member by an electrophoresis method.

However, in the case where the thermionic emission filament is used, for example, in a mass spectrometer such as residual gas analyzer for analyzing residual gas in a semiconductor process chamber, corrosive gasses such as fluorine gas used for cleaning inside the chamber may be possibly contained in the gas to be analyzed. In such a case, since the electron emitting layer formed by an electrophoresis method has no denseness, the corrosive gasses may penetrate through clearances of the electron emitting layer and reach the core member. Therefore, the core member is corroded and the thermionic emission filament is liable to be broken earlier than an expected lifetime.

Therefore, in the case where the thickness of the electron emitting layer is increased in order to protect the core member from corrosion, since the thermionic emission filament is still liable to be broken earlier than an expected lifetime due to thermal stress.

Further, in order to extend the life of the thermionic emission filament, although it appears to be considered that, after the residual gas of a low concentration in the semiconductor process chamber is further diluted, the gas is analyzed by a mass spectrometer, there arises a problem that the analyzing accuracy is deteriorated.

CITATION LIST

Patent Literature

Patent Literature 1: JP2012-003976A

Non-Patent Literature

Non-Patent Literature 1: "The Quadrupole Mass Spectrometer as a Residual Gas Analyzer", Naoki Takahashi, J. Vac. Soc. Jpn., Vol. 48 (2005), p 611-618

SUMMARY OF INVENTION

Technical Problem

Therefore, the present invention has been made in order to solve the above problems, and an essential object thereof is to provide a thermionic emission filament capable of ensuring a long life and improving an analysis accuracy of a mass spectrometer using this thermionic emission filament.

Solution to Problem

In one aspect of the present invention, a thermionic emission filament includes a core member through which electric current flows and an electron emitting layer which is formed so as to cover a surface of the core member, and in this configuration, the electron emitting layer is made to have denseness for substantial gas-tight integrity.

With this configuration, since the surface of the core member is covered with the electron emitting layer having denseness for gas-tight integrity, it is possible to suppress corrosion of the core member even in the case where the filament is directly exposed to corrosive gasses, and the life of the thermionic emission filament can be extended.

Further, since the electron emitting layer is dense, it is possible to have a gas-tight configuration even without making the electron emitting layer thicker than necessary, and it is possible to suppress the breakage of the thermionic emission filament due to thermal stresses or the like. Thus, the life of the thermionic emission filament can be extended.

Furthermore, since the corrosion of the core member can be suppressed even in the case where the filament is directly exposed to corrosive gasses, it is possible to directly analyze the gasses by the mass spectrometer using this thermionic emission filament without diluting the gasses to thereby improve the analysis accuracy of the mass spectrometer.

The preferred electron emitting layer is formed by any one of CVD method, PVD method, or thermal spraying method.

By using any one of CVD method, PVD method, or thermal spraying method, it is possible to form the electron emitting layer having the denseness for substantial gas-tight integrity on the surface of the core member.

When forming the electron emitting layer by the CVD or PVD method, since the component of the electron layer is once gasified to be made fine and then fixed to the core member to thereby form the electron emitting layer, a dense electron emitting layer can be formed.

Further, since the component of the electron emitting layer is sprayed as particles in a unit of few nanometers even in the thermal spraying method, a dense electron emitting layer can be formed.

When forming the electron emitting layer by thermal spraying, since a jet intensity of a coating material is strong and a strong rigidity of the core member is required, the thermal spraying method may not be used in the case of using a thin core member.

Furthermore, in the PVD method in which particles having high energy are collided to the material of the electron emitting layer to thereby physically sputter off the material and laminate the material on the surface of the core member, or in the thermal spraying method in which the material of the electron emitting layer is dissolved and injected to thereby laminate the material on the surface of the core member, a dense film thereof can be formed on only one side of the core member by one-time operation. Therefore, it is necessary to form the electron emitting layer while changing the target surface little by little and this results in an increased cost and time-consuming labor to fabricate a filament for electron emission.

Meanwhile, in CVD method, heat, light, or high frequency is supplied to the gas containing the material of the electron emitting layer to increase reactivity of the gas, and thus the gaseous material is fixed to the surface of the core member to thereby form the electron emitting layer. Therefore, a dense electron mitting layer can be formed at once on the entire surface of the core member contacting with the gas filled in a vacuum chamber without increased cost and time-consuming labor, and therefore CVD method is particularly effective in fabricating the thermionic emission filament of the present invention.

The preferred thermionic emission filament has a wire shape.

In the case where the thermionic emission filament has a linear shape which is weak against cutoff due to corrosion of the core member, it is possible to remarkably exhibit life prolongation of the thermionic emission filament of the present invention.

The preferred thickness of the electron emitting layer is in the range of 1 μm to 30 μm.

If the thickness of the electron emitting layer is thinner than 1 μm, the electron emitting layer is easily evaporated and the denseness of the film is likely to be lowered. Therefore, there may occur breakage in the core member due to corrosion thereof and the thermionic emission filament may also be broken in a short period of time. Further, if the thickness of the electron emitting layer is thicker than 30 μm, there may be liable to occur breakage in the thermionic emission filament due to thermal stresses as described above. Therefore, in the case where the thickness of the electron emitting layer is in the range of 1 μm to 30 μm, these defects can be prevented from occurrence and the life of the thermionic emission filament can be extended.

The preferred core member of the thermionic emission filament is made of iridium and the preferred electron emitting layer is made of yttrium oxide.

Since iridium is chemically stable and breakage thereof due to oxidation hardly occurs compared to tungsten which is a general material of the core member, it is suitable for the material of the core member. Meanwhile, iridium has poor thermionic emission efficiency. Therefore, in the case where the surface of the core member made of iridium is coated with the electron emitting layer made of yttrium oxide which is an electron emitting substance, the thermionic emission efficiency can be improved. Thus, it is possible to provide a thermionic emission filament which well suppresses occurrence of breakage and has good thermionic emission efficiency as well.

A preferred mass spectrometer including the thermionic emission filament is a quadrupole mass spectrometer.

Further, an analyzing method using the quadrupole mass spectrometer is preferably a residual gas analyzing method for analyzing residual gas in a semiconductor process chamber.

With such a quadrupole mass spectrometer and a residual gas analyzing method, since these spectrometer and method can be subjected to direct analysis of the gas in the chamber, it is possible to improve the analyzing accuracy of the mass spectrometer.

Advantageous Effects of Invention

According to the present invention configured as described above, since the surface of the core member is covered with the electron emitting layer having denseness for gas-tight integrity, it is possible to suppress corrosion of the core member even under the condition of corrosive gases being present, and the life of the thermionic emission filament can be extended.

Further, according to the thermionic emission filament of the present invention, since the electron emitting layer is dense and it is possible to have a gas-tight configuration even without making the electron emitting layer thicker than necessary, it is possible to suppress breakage of the thermionic emission filament due to thermal stresses or the like. Thus, the life of the thermionic emission filament can be extended.

Furthermore, according to the mass spectrometer using the thermionic emission filament of the present invention, the gases can be directly analyzed without diluting the gasses, and therefore the analysis accuracy of the mass spectrometer can be improved.

DESCRIPTION OF EMBODIMENTS

The following describes one embodiment of the present invention with reference to the accompanying drawings.

A thermionic emission filament 211 according to the present embodiment is attached to, for example, a semiconductor process chamber C and the like and it is used for a residual gas analyzer RGA for analyzing the residual gas in the chamber C.

The residual gas analyzer RGA is, for example, a quadrupole mass spectrometer, which includes a casing 1, a sensor part 2 accommodated in the casing 1, and a data processing circuit 3.

Figure 1:
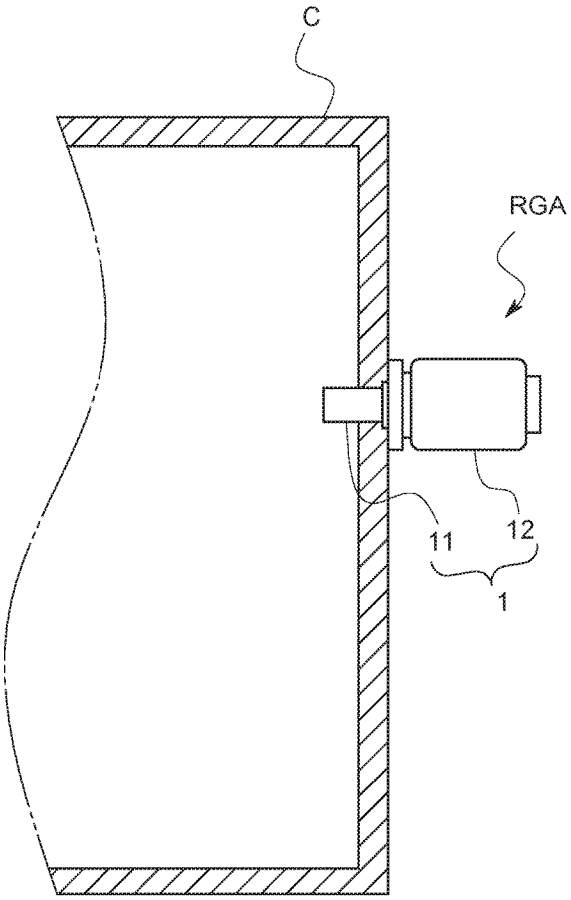
FIG. 1 is a schematic diagram showing an attachment state of a residual gas analyzer according to one embodiment of the present invention to a semiconductor process chamber.

As shown in FIG. 1, the casing 1 has a cylindrical shape with a diameter of 2 cm to 3 cm and a length of approximately 5 cm, and the casing 1 includes: a sensor part cover 11 which accommodates the sensor part 2; and a data processing circuit cover 12 which accommodates the data processing circuit 3. The sensor part 11 is attached to the chamber C so that a distal end surface thereof is located within the chamber C. Meanwhile, the data processing circuit cover 12 is located outside the chamber C when attached to the chamber C.

In the distal end surface of the sensor part cover 11 located within the chamber C, there is formed a gas inlet port 111 for introducing the gas in the chamber C into the sensor part 2.

Figure 2:
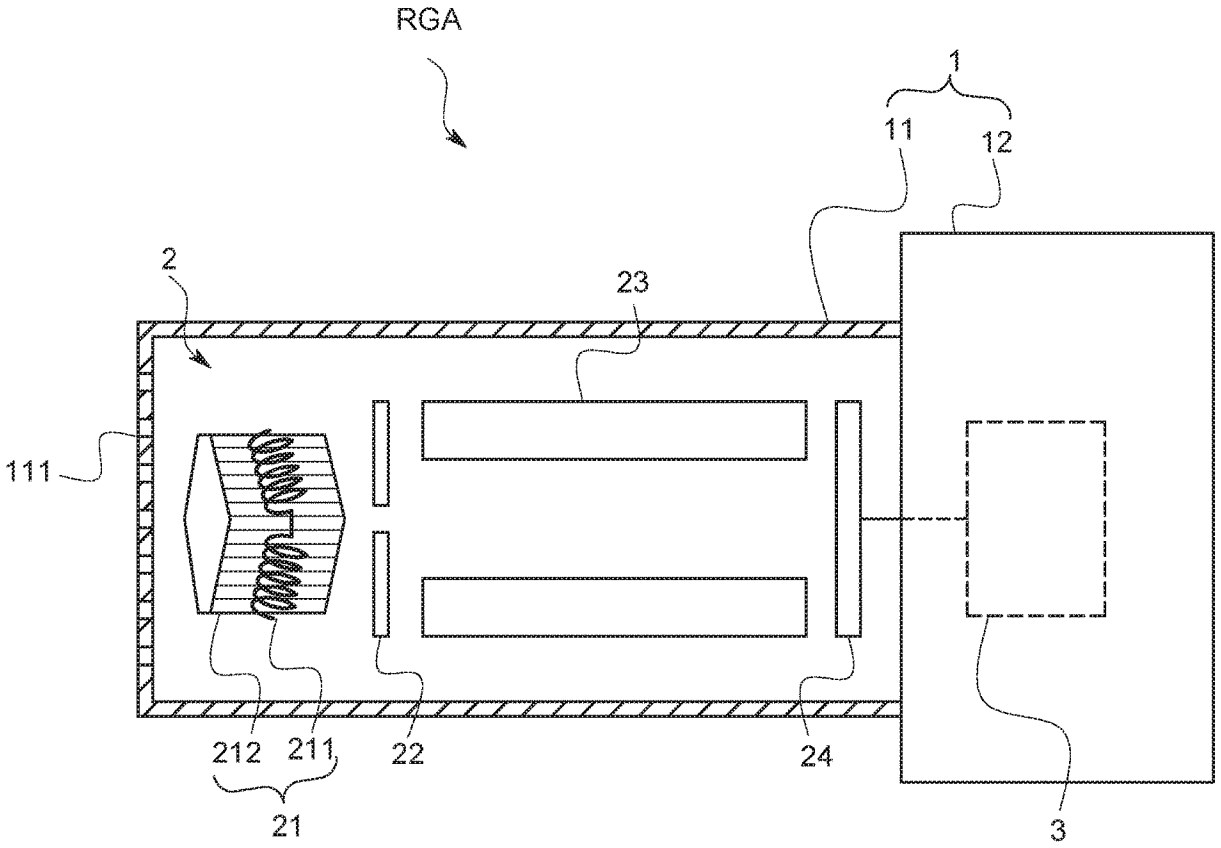
FIG. 2 is a schematic diagram of an internal structure of the residual gas analyzer according to the same embodiment.

As shown in FIG. 2, the sensor part 2 includes: an ionization part 21; an ion extraction electrode 22; a quadrupole part 23; and a detection part 24. The ionization part 21 ionizes the gas by electron collision. The ion extraction electrode 22 extracts the ions generated in the ionization part 21 from the ionization part 21 and accelerates and converges the extracted ions. The quadrupole part 23 separates the ions accelerated and converged by the ion extraction electrode 22 according to a charge-to-mass ratio by a high frequency electric field generated by four cylindrical electrodes. The detection part 24 catches the ions separated by the quadrupole part 23 and detects as a current value and outputs the current value to the data processing circuit 3.

The ionization part 21 includes a wire-shaped thermionic emission filament 211 and a cylindrical grid electrode 212. The thermionic emission filament 211 is formed in a coil shape and the end parts thereof are connected to the data processing circuit cover 12 including a built-in power supply unit (not shown). The grid electrode 212 is located inside the thermionic emission filament 211 and collects and accelerates the thermal electrons emitted from the thermionic emission filament 211.

The thermionic emission filament 211 is disposed, for example, in a direction substantially perpendicular to the axial direction of the hexagonal column grid electrode 212 around the side surface of the hexagonal column grid electrode 212 having an opening at its distal end. Specifically, the coil portions of the thermionic emission filament 211 are disposed along the side surface of the hexagonal column grid electrode 212.

The structure of the grid electrode 212 is not limited to a hexagonal column shape and it may be a cylindrical shape or a tubular shape having cross section of other polygonal or different shape.

The thermionic emission filament 211 may be any of wire state and the shape thereof is not limited to a coil shape, and it may be of other shapes such as a ring shape or a hairpin shape.

Figure 3:
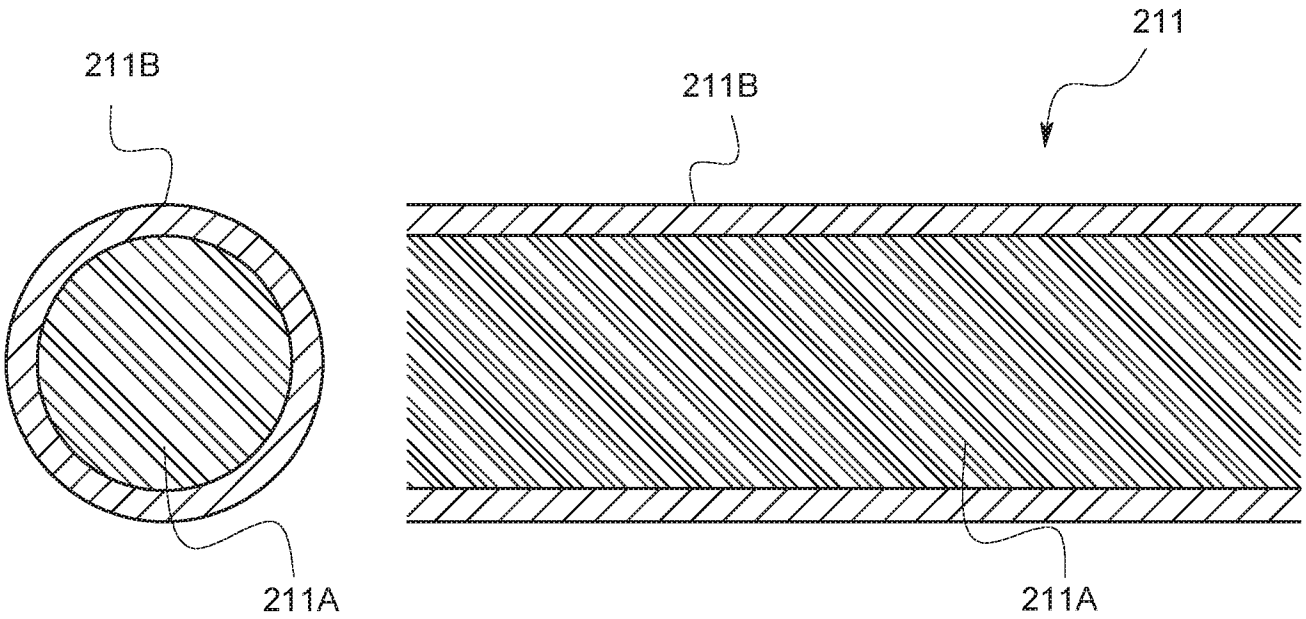
FIG. 3 is a cross-sectional view of a thermionic emission filament according to the same embodiment.

As shown in FIG. 3, the thermionic emission filament 211 includes a core member 211A in which electric current flows and an electron emitting layer 211B which is configured so as to cover the entire surface of the core member 211A.

For example, the core member 211A is made of iridium as a main component having a thickness of 70 μm to 130 μm and it may contain impurities.

For example, the electron emitting layer 211B is made of yttrium oxide as a main component and it may contain impurities. The electron emitting layer 211B is formed by, for example, CVD method, and this layer is approximately 2 μm thick, having denseness for substantial gas-tight integrity in a degree of an atomic level. As described above, in the case where the thickness of the electron emitting layer 211B is thinner than 1 μm or thicker than 30 μm, the electron emitting layer 211B may be easily evaporated or the thermionic emission filament 211 may be liable to be broken due to thermal stress. Therefore, the preferred thickness of the electron emitting layer 211B is in the range of 1 μm to 30 μm.

The method of forming the electron emitting layer 211B by CVD method is, for example, as follows. First, the iridium core members 211A of the thermionic emission filaments 211 are fixed or hanged one by one or a plurality of iridium core members 211A are collectively fixed or hanged in a standing posture so that the entire surface of each of the core members 211A is exposed to a space in the vacuum chamber. Under this condition, by heating the gas containing oxygen and yttrium as a material of the electron emitting layer 211B within the vacuum chamber and increasing the reactivity of the gas, the gas is secured to the surface of each of the core members 211A to thereby form the dense electron emitting layer 211B made of yttrium oxide covering the entire surface of each of the core members 211A.

In the present embodiment, although CVD method is used as a method for forming the electron emitting layer 211B on the surface of the core member 211A, PVD method or thermal spraying method may be also used in order to form the electron emitting layer 211B having denseness for substantial gas-tight integrity.

The data processing circuit 3 includes: an amplifier; an A/D converter; a CPU; a memory; a communication port and the like, and it is configured to perform mass spectrometry based on a current value outputted from the sensor part 2. Further, if necessary, the analysis results thereof are transmitted to a general purpose computer and the like.

The data processing circuit 3 may be a single device or a plurality of devices connected to each other by wire or wireless, or it may be configured to use a general purpose computer as a part thereof.

According to the thermionic emission filament 211 of the present embodiment configured as described above, even if there exists corrosive gas such as fluorine gas and the like used for cleaning the semiconductor process chamber C in the gas to be analyzed by the residual gas analyzer RGA, since the entire surface of the core member 211A is covered with the electron emitting layer 211B having denseness substantially without any clearance through which the gas passes, the corrosion of the core member 211A can be suppressed and the life of the thermionic emission filament 211 can be extended.

In addition, by setting the thickness of the electron emitting layer 211B within the range of 1 μm to 30 μm, it is possible to prevent the evaporation of the electron emitting layer 211B and the exposure of the core member 211A to the corrosive gas. Therefore, it becomes possible to suppress breakage of the thermionic emission filament 211 due to thermal stress and the like, and thus the life of the thermionic emission filament 211 can be extended.

Further, according to the residual gas analyzer RGA using the thermionic emission filament 211 of the present embodiment, since the gas in the chamber C can be directly analyzed without dilution, the analyzing accuracy can be improved.

By using CVD method as a method for forming the electron emitting layer 211B on the surface of the core member 211A, the dense electron emitting layer 211B can be formed on the entire surface of the core member 211A by one-time operation.

In the case where the thermionic emission filament 211 is coil-shaped, CVD method is particularly suitable since the dense electron emitting layer 211B can be formed by one-time operation even on complex surfaces.

Further, by fixing the yttrium oxide particles to the surface of the core member 211A by CVD method, the electron emitting layer 211B can be formed in a nanometer order or smaller.

Next, the life prolongation of the thermionic emission filament 211 according to the present embodiment will be described performing a test as follows.

As one example of the thermionic emission filament 211 according to the present invention, there was prepared the yttrium oxide thermionic emission filament 211 having a thickness of 75 μm by coating the iridium core member 211A with the yttrium oxide electron emitting layer 211B having a thickness of 20 μm or smaller, and a test was performed continuously using the residual gas analyzer RGA equipped with this thermionic emission filament 211 for 500 hours under $SF_6$ atmosphere of $1\times10^{-3}$ Pa.

As a result, although the resistance value of the thermionic emission filament 211 was increased by 10% and the wire diameter was reduced by 5%, it was possible to continuously use the thermionic emission filament 211 for 500 hours without occurrence of breakage. Moreover, also as to analysis sensitivity after 500 hours, it can be maintained 80% or more compared to that at the time of starting the analysis.

Note that the present invention should not be limited to the above embodiment.

For example, the thermionic emission filament includes a core member through which electric current flows and an electron emitting layer which is formed so as to cover the surface of the core member, and in this configuration, the electron emitting layer may be formed by any one of CVD method, PVD method, or spraying method.

The thermionic emission filament according to the present invention is not limited for use in the quadrupole mass spectrometer, and it may be also used for another mass spectrometry using an electron ionization method, scanning electron microscope using an electron beam, and the like.

The material of the core member is not limited to iridium, but iridium rhodium alloy, rhodium, rhenium tungsten alloy, tungsten, and the like may be also used as the material.

The component of the electron emitting layer is not limited to yttrium oxide, but any substance having a low work function and high melting point such as thorium may be also used.

When the thickness of the thermionic emission layer is increased, the denseness thereof is improved accordingly, and therefore the thickness of the thermionic emission layer is not limited to the range of 1 μm to 30 μm, and the thickness may be out of this range, for example, 30 μm or more. In particular, the thickness of the thermionic emission layer is preferably in the range of 1 μm to 15 μm, and more preferably in the range of 1 μm to 5 μm.

The electron emitting layer 211B is having denseness for substantial gas-tight integrity in nano order. For example, the density of yttrium oxide of 4.0 g/m$^3$ or more is suitable. The density of yttrium oxide of 4.9 g/m$^3$ or more is preferable.

Further, the shape of the thermionic emission filament is not limited to a wire shape which is a cylindrical one having a diameter of about 70 μm to 100 μm, but it may be another shape such as a plate shape (ribbon shape) which is a belt shaped one having a thickness of several tens of μm and a width of about 1 mm.

In addition, various modifications of the present invention can be made without departing from the spirit thereof.

REFERENCE SIGNS LIST

211 . . . Thermionic emission filament
211A . . . Core member
211B . . . Electron emitting layer
RGA . . . Residual gas analyzer

The invention claimed is:

1. A mass spectrometer comprising:

an ionizer having a thermionic emission filament which includes a core member through which electric current flows; and an electron emitting layer which is formed so as to cover a surface of the core member, wherein:

the electron emitting layer is made to have denseness for substantial gas-tight integrity, and the thickness of the electron emitting layer is 1 μm to 15 μm;

a separator that separates ions generated in the ionizer; and a detector that catches and detects the ions separated by the separator.

2. The mass spectrometer according to claim 1, wherein the electron emitting layer is formed by any one or combination these of CVD method, PVD method, or thermal spraying method.

3. The mass spectrometer according to claim 1, wherein the thermionic emission filament has a wire shape or a plate shape.

4. The mass spectrometer according to claim 1, wherein the core member is made of iridium, iridium rhodium alloy, or rhodium and the electron emitting layer is made of yttrium oxide.

5. A residual gas analyzing method for analyzing residual gas in a semiconductor process chamber, the method comprising:

providing a quadrupole mass spectrometer having an ionizer having a thermionic emission filament which includes a core member through which electric current flows; and an electron emitting layer which is formed so as to cover a surface of the core member;

providing the electron emitting layer with a denseness for substantial gas-tight integrity, wherein the thickness of the electron emitting layer is 1 μm to 15 μm;

separating ions generated in the ionizer; and catching and detecting the separated ions.

6. A method for manufacturing a thermionic emission filament for use in a mass spectrometer, the filament having a core through which electric current flows, the method comprising:

forming an electron emitting layer to cover a surface of the core by one or more of a CVD method, a PVD method, and a thermal spraying method, wherein the thickness of the electron emitting layer is 1 μm to 15 μm; and providing the electron emitting layer with a denseness for substantial gas-tight integrity.

* * * * *